US007264247B2

(12) United States Patent
Singer

(10) Patent No.: US 7,264,247 B2
(45) Date of Patent: Sep. 4, 2007

(54) ENTERTAINMENT AND REFRESHMENT ASSEMBLY

(75) Inventor: Craig B. Singer, 4534 Old Denton Rd., Carrollton, TX (US) 75008

(73) Assignee: Craig B. Singer, Carrollton, TX (US)

( * ) Notice: Subject to any disclaimer, the term of this patent is extended or adjusted under 35 U.S.C. 154(b) by 174 days.

(21) Appl. No.: 10/859,681

(22) Filed: Jun. 3, 2004

(65) Prior Publication Data

US 2005/0269768 A1 Dec. 8, 2005

(51) Int. Cl.
*A63F 9/30* (2006.01)

(52) U.S. Cl. ..... 273/447; 273/138.1; 273/138.2; 463/16; 463/46; 221/199; D21/325; D20/5

(58) Field of Classification Search ..... 273/447, 273/448, 442, 138.1, 138.2; 463/46, 16; 194/350; 221/199; D21/325, 326; D20/5
See application file for complete search history.

(56) References Cited

U.S. PATENT DOCUMENTS 4,560,088 A 12/1985 Tan
4,966,304 A * 10/1990 Kelly ..... 221/6
5,513,772 A 5/1996 Glaser
5,628,685 A * 5/1997 Takemoto et al. ..... 463/25
5,967,892 A 10/1999 Shoemaker
6,139,429 A 10/2000 Shoemaker
6,253,955 B1 7/2001 Bower
6,283,475 B1 9/2001 Stubben
6,315,157 B1 11/2001 Halliburton
6,328,180 B1 12/2001 Sorensen et al.
6,428,008 B1 8/2002 Singer
6,564,964 B2 5/2003 Johnson
6,588,760 B2 7/2003 Carter et al.
6,598,881 B1 7/2003 Shoemaker
6,695,698 B1 2/2004 Anghelo et al.
2003/0011133 A1 1/2003 Uedono
2004/0011805 A1 1/2004 Crompton

FOREIGN PATENT DOCUMENTS

JP 11007572 A * 1/1999

* cited by examiner

*Primary Examiner*—Benjamin Layno
(74) *Attorney, Agent, or Firm*—Vedder Price Kaufman & Kammholz

(57) ABSTRACT

An entertainment and refreshment assembly with various arcade games and vending machines including a large housing having an exterior configuration resembling a vehicle. The interior portion includes a plurality of separate receptacles which each receive any combination of the arcade games and/or a vending machines. The arcade games and vending machine may have side panels with a transparent portion. The housing also has at least one transparent panel on the exterior surface. A plurality of panels further define the interior, and at least one of the panels has an aperture. The configuration of the present invention permits a longitudinal and lateral line-of-sight to pass unimpaired completely through the assembly to increase the visibility of the prizes and refreshments to the spectators and players.

19 Claims, 5 Drawing Sheets

ENTERTAINMENT AND REFRESHMENT ASSEMBLY

BACKGROUND OF THE INVENTION

The present invention relates generally to arcade games, vending machines and more particularly to an entertainment and refreshment assembly including a housing for multiple combinations of arcade-style games and vending machines in which the visibility of the gaming action for the spectators and operators may be increased, appetites are whetted and satisfied, greater participation is encouraged and revenue generation is increased.

Historically, video or skill manipulation arcade-style games were designed and constructed with the primary emphasis focused on the game operator. Likewise, vending machines were similarly constructed and configured. The line-of-sight, control console and feedback were very restrictive and directed. In reality, only the operator could reasonably view what transpired during the game. Traditionally, the housings for these games were solitary units constructed primarily of flat panels with painted graphics as the sole identifying characteristic of the game. Often times the side panels were not contoured to permit advantageous viewing angles for spectators from the sides. A different group of arcade-style games were designed to position an operator inside a relatively enclosed space to enhance the game experience. Some of these enclosures were of a cubicle style, while more recent ones resembled the vehicle portrayed in the game. Rarely were the arcade games or vending machines designed to attract patrons based on factors other than the actual games or units themselves.

There are many disadvantages of these prior art types of arcade games and vending machines, including size limitations, complexity of design, ability to engage the interaction of numerous operators simultaneously, inability of spectators to observe and cost of construction and operation. Nearly all multiplayer games are incredibly large, unwieldy, expensive to manufacture and linearly arranged. This type of arrangement makes observation of another operator's game difficult. The design of these multiplayer games becomes more complex the larger they become. Clear lines-of-sight for spectators, passers-by or other operators are difficult to achieve with the linear or enclosed design. Likewise, similar disadvantages exist for current vending machines and the configurations thereof.

A recent development, by the inventor hereof, is directed to a game housing with multiple games disposed therein and operators positioned externally. Transparent panels and reflective portions enable the games to be openly viewed by players, spectators and passers-by. Increased revenue has been realized from such a configuration where the arcade-style games are designed to encourage a greater number of spectators to observe than players. Such development accomplishes this with a unique housing and game configuration. The challenge to do better, score higher or collect more prizes is more relevant when the spectators and other competitors can view the gaming action. Additionally, the simultaneous operation by a number of players who can easily view one another's actions also encourages competition in contrast to other games which are configured linearly which makes it difficult for operators to view one another's performance. Furthermore, the linear relationship requires a significant amount of space.

Another aspect of the recent development is that housing a plurality of games in the space required for an enclosed single player game, provides the added benefit of permitting all of the players to see each other and encouraging spectator participation through increased visibility. Furthermore, since the game players are positioned about the perimeter of the housing, and a large number of games may be disposed therein, the costs of operation per square foot of floor space are dramatically reduced due to the increased revenue per game housing. Placement of the development has been successfully introduced into previously unconventional or unavailable locations, such as mall walkways.

The present invention further enhances all advantages of the prior art development by providing an entertainment and refreshment assembly with a mixture of a plurality of arcade games and vending machines or just vending machines. Transparent panels may be provided on the vending machines to take advantage of the benefits of clear line-of-sight through the entertainment assembly. Revenue derived from an entertainment and refreshment assembly constructed in accordance with the present invention is further enhanced for various reasons. Patrons looking for a snack or drink are drawn to the entertainment and refreshment assembly for such and continue to remain in the vicinity thereof to observe the players operating the arcade games or investigate what other snacks or drinks are available. Also, those players who take a break from the competition can grab a snack or drink without leaving the vicinity of the entertainment assembly. Further, hungry individuals are also drawn to the entertainment and refreshment assembly particularly when the assembly includes all vending machines. The enticing appearance of the hosing and gathering of others around the entertainment assembly has been found to increase the patron's appetite. Accordingly, interest, participation, competition and even appetite is increased and as a result thereof, revenue is further increased over the prior art development. All of these advantages over the prior art development are realized without an increase in footprint or cost of operation per square foot of floor space.

Therefore, there exists a need in the art for an entertainment and refreshment assembly which overcomes the disadvantages of the prior art, provides a unique experience for arcade game players and observers, and those looking for refreshment, enhances revenue and does not increase operating costs.

BRIEF DESCRIPTION OF THE DRAWINGS

In the course of the following detailed description, reference will be made to the accompanying drawings wherein like reference numerals identify like parts and in which.

DETAILED DESCRIPTION OF THE PREFERRED EMBODIMENTS

Figure 1:
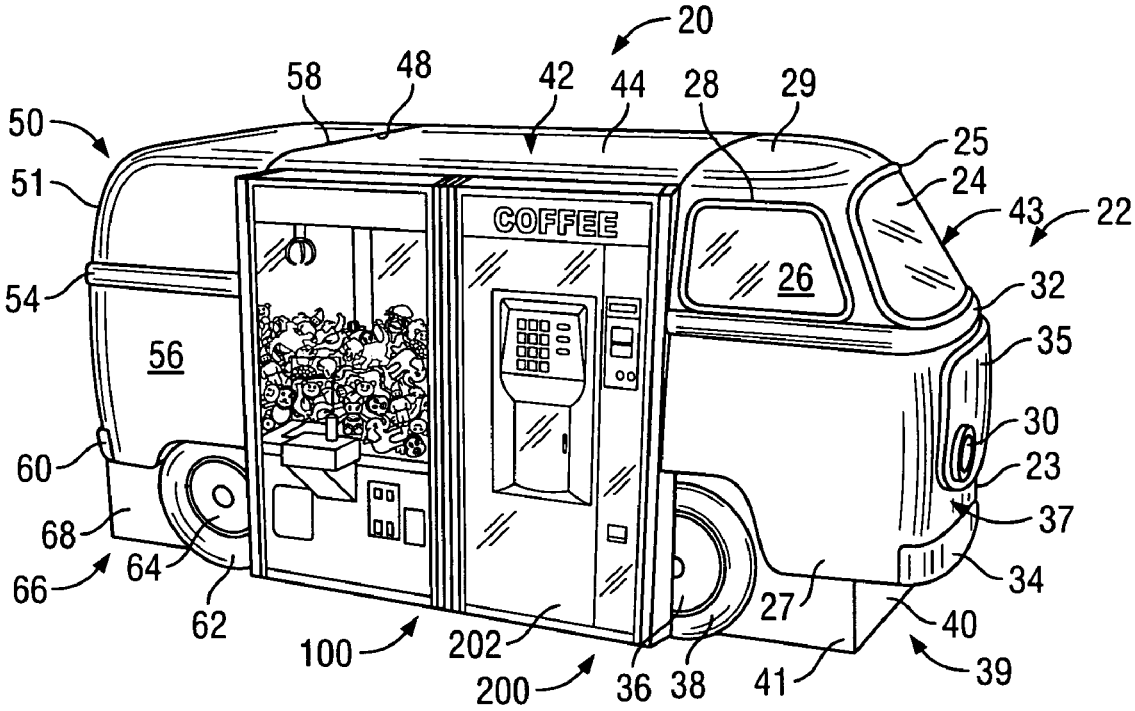
FIG. 1 is a perspective side view of an entertainment assembly constructed in accordance with the principles of the present invention.

One principal aspect of the present invention that is exemplified by one embodiment thereof includes a plurality of arcade games and a plurality of vending machines, a pair of end sections spaced apart and joined to one another by an interconnecting portion that defines an opening that accommodates at least two different receptacles for receiving the arcade games and vending machines. Additionally, another receptacle is defined in one of the end sections which is proximate, adjacent and contiguous to the other receptacles. The visibility of the prizes, refreshments and game action for spectators and game operators is greatly increased by the adjacent configuration of all the receptacles, arcade games and vending machines.

In another principal aspect of the present invention, distinguishing features are provided on the exterior of the housing end sections to entice spectator interest, increase participation, and to readily identify the housing as a particular type of vehicle. The features often include headlights, taillights, insignia, windshield, trim, bumpers, door windows, body lines, wheels and tires, but are not limited thereto.

In a further principal aspect of the present invention, the receptacles are further defined by a plurality of interior panels having a reflective portion and an aperture. A longitudinal line-of-sight passes directly through the housing along the longitudinal axis unimpaired.

In a still further principal aspect of the present invention, one receptacle is defined in a vehicle rear section.

In still another principal aspect of the present invention and as exemplified by another embodiment thereof, an entertainment and refreshment assembly includes a plurality of arcade games and vending machines with a housing having an exterior which represents a vehicle body, and an interior which defines a plurality of separate receptacles in the housing for receiving the arcade games and vending machines which each have a plurality of side panels that are transparent. Additionally, the housing has a plurality of exterior transparent panels through which spectators may observe the refreshments and gaming action. The interior is defined by a plurality of panels with one having an aperture therein. This aperture and the transparent panels located on the game units and housing exterior provide longitudinal and lateral lines-of-sight which pass unimpaired completely through the assembly, thereby greatly increasing the visibility of the prizes, refreshments and gaming action for the spectators and game players alike.

In yet another principal aspect of the present invention as exemplified by another embodiment thereof, an entertainment and refreshment assembly includes a plurality of vending machines with a housing having a pair of end sections spaced apart and joined to one another by an interconnecting portion that defines an opening to accommodate at least two different receptacles for receiving the vending machines. Additionally, another receptacle is defined in one of the end sections which is proximate, adjacent and contiguous to the other receptacles. The visibility of the refreshments is greatly enhanced by the adjacent and configuration of all the receptacles and vending machines. Furthermore, branding campaigns by a company with diverse refreshment products may be successfully facilitated by this advantageous design.

The present invention is directed to an improved entertainment and refreshment assembly particularly useful for containing a large number of arcade games and vending machines in a relatively small space, attracting more participants to the games, generating more revenue and conserving footprint size in space restricted locations. More specifically, the present invention positions arcade games and vending machines adjacent to each other about the exterior of the housing and uses a plurality of transparent panels on the games to greatly increase the visibility of games to spectators and players, thereby attracting the attention of potential players and patrons, and encouraging participation, competition and purchasing.

An entertainment and refreshment assembly embodying the concepts of the present invention is designated generally by reference numeral 20 in the accompanying drawings. As shown in FIGS. 1, 4, 6, 8 and 9, the game assembly 20 generally includes a front end section 22, an intermediate section 42, and a rear end section 50. These three different sections 22, 42 and 50 may be formed separately for assembly in a modular fashion for a cost-effective solution. However, the entire assembly may also be formed as a singular element, if so desired. The material of construction for each part can be from any of a variety of materials usually used to create such objects. Composite materials such as fiberglass, will be most often used.

The front section 22, as illustrated, emulates the front of a vehicle and may include a front, leading portion 23, a pair of side (door) portions 27, a top, roof portion 29, a base portion 39, and a rear panel or wall 31. There are many distinguishing features on the front end section 22 which enable viewers to identify that the front end section 22 resembles a vehicle. Depending on the vehicle of choice, the front end section 22 may take numerous different shapes, sizes and forms. These distinguishing features which characterize the assembly 20 as a vehicle and thereby create curiosity and interest from potential players, drawing them closer to the refreshments and/or gaming action. Additionally, the vehicle may be decorated with the brands, logos or other identifying indicia of a certain refreshment product manufacturer to generate further interest and attraction toward the gaming action or vending machines. Further, the configuration of the present invention facilitates a "blitz-type" refreshment product introduction thereby greatly increasing brand awareness and market penetration.

As further shown in FIGS. 1, 4, 6, 8 and 9 the front, leading portion 23 has a lower element 37 which is substantially vertically oriented, and an upper element 38 which is inclined away from the lower element 37 toward the rear end section 50. Preferably, several distinguishing features which may characterize the front, leading portion 23, including a transparent windshield 24, windshield trim 25, raised portion 35, headlights 30, bumper 34 and a body belt line 32. The front end section 22 also has a pair of laterally opposed side (door) portions 27 illustrated as integrally formed with the front, leading portion 23. The side (door) portion 27 may be characterized by several distinguishing features which may include a transparent side, door window 26, window trim 28, body belt line 32, wheel 36 and tire 38. The top, roof portion 29 joins the upper edges of the front, leading portion 23 and each side, door portion 27 and has a generally contoured shape to suggest integral construction. Due to the constraints of actual physical construction with regard to faithful representation of the desired vehicle a base portion 39 may be visible near the ground. Front 40 and side 41 elements may preferably include a wood structure which supports and balances the front end section 22, and may be visible near the wheel 36 and tire 38 assembly.

Figure 5:
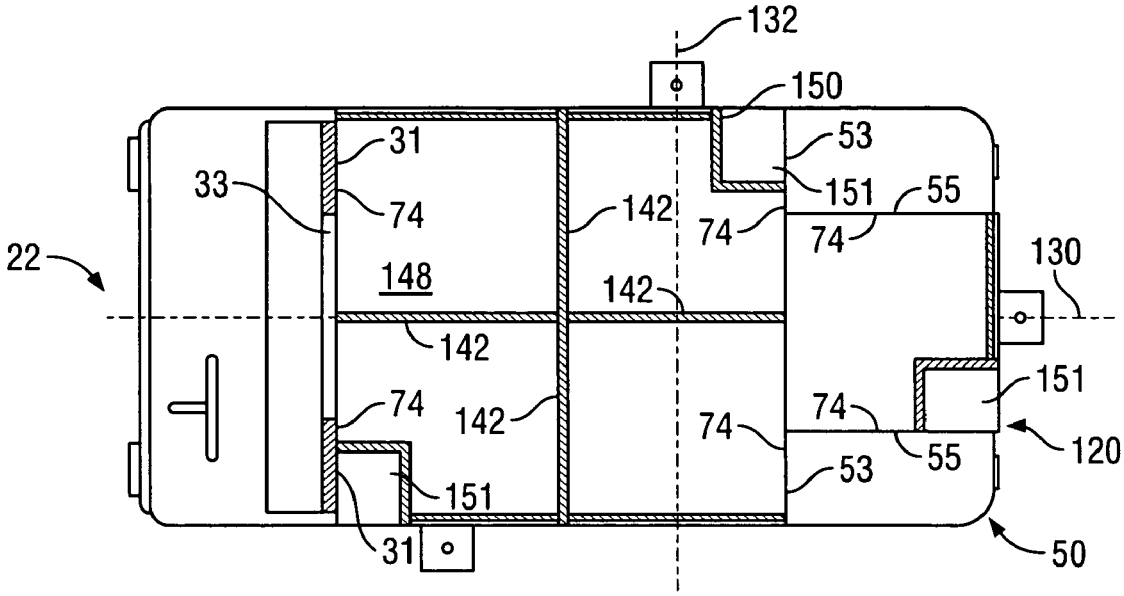
FIG. 5 is a cross-sectional view of one embodiment of the entertainment assembly of FIG. 1 taken along line 5-5 in FIG. 4.

As shown in FIG. 5, a rear panel or wall 31 defines the back end of the front end section 22 described above and joins all of the edges thereof together, substantially enclosing what may be described as the passenger compartment of the vehicle. An aperture 33 is formed in the rear panel 31 to permit viewers to view the prizes, gaming action or refreshment products from outside the front end section. Preferably, the aperture 33 is sized such that the viewers may observe from numerous angles without hindrance.

Figure 2:
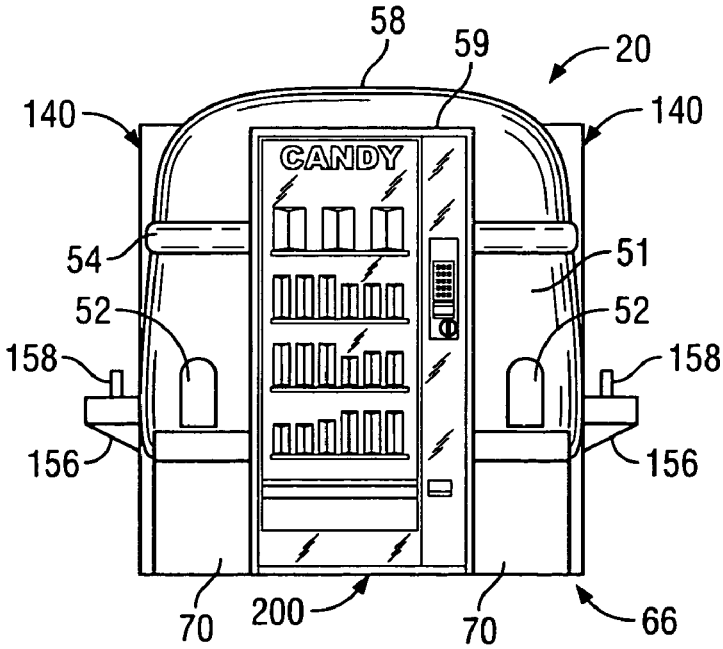
FIG. 2 is rear view of one embodiment of the entertainment assembly of FIG. 1.
Figure 4:
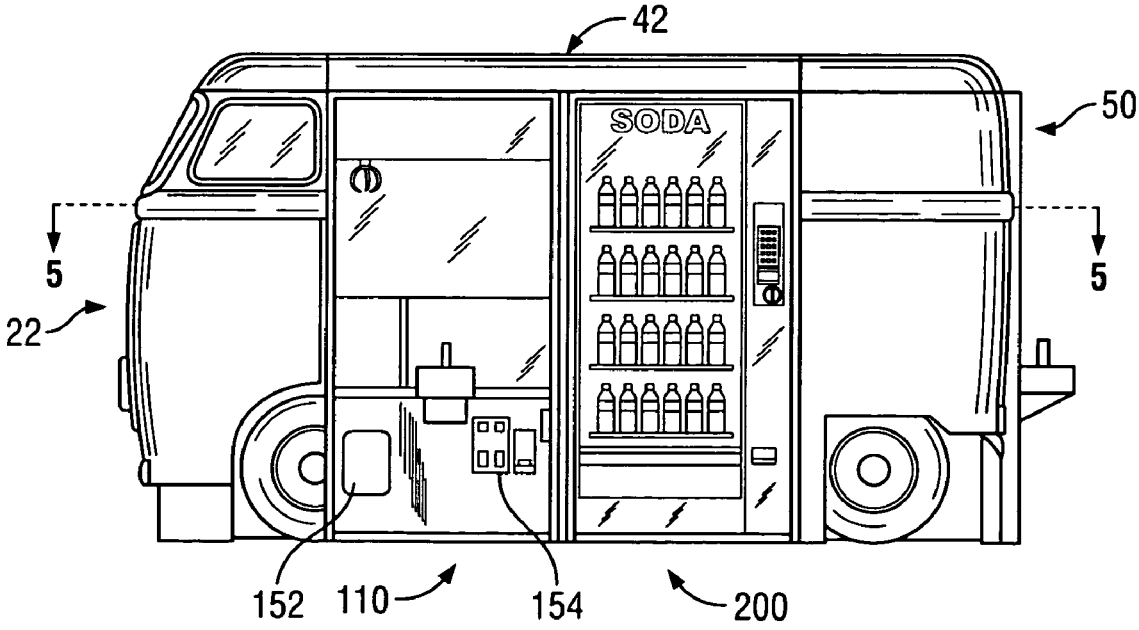
FIG. 4 is a side elevation view of one embodiment of the entertainment assembly of FIG. 1.
Figure 6:
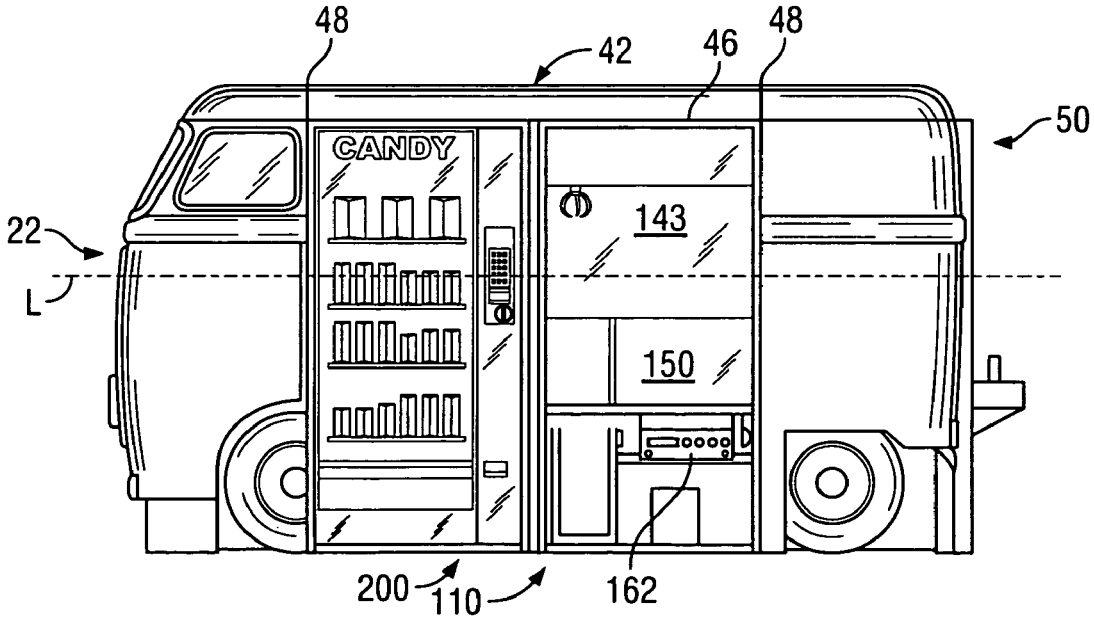
FIG. 6 is a side elevational view of one embodiment of the entertainment assembly of FIG. 1.

As shown in FIGS. 2, 4 and 6, the rear end section 50 comprises a back portion 51, a pair of substantially identical sides 56, a roof (top) portion 58, a base portion 66, a pair of parallel laterally opposed panels or walls 55, and a front panel or wall 53. Several distinguishing features may characterize the rear end section 50 as a vehicle, including, taillights 52, body belt line 54, wheels 64, tires 62 and a bumper 60. In order to faithfully represent a vehicle, a base portion 66 may be visible near the ground. The base portions 39 and 66 are preferably constructed and designed according to conventional standards to provide the function described above. Rear 70 and side 68 elements may be visible near the wheel 64 and tire 62 assemblies.

As best shown in FIGS. 2 and 5, a third receptacle 120 within the rear end section 50, is defined by a pair of generally parallel, laterally opposed panels or walls 55 which extend from the front panel 53 rearwardly to the back portion 51. A bottom element 59 of the roof 58, having a preferably planar configuration, further defines the third receptacle 120. Consequently, the third receptacle 120 may be further characterized as having a rectangular volume.

As shown in FIGS. 1, 3, 4, 6, 8 and 9, the intermediate section 42 has a top portion 44, a bottom portion 46 and a pair of end portions 48. Additionally, it may, as illustrated extend partly over the front and rear end sections 22 and 50 or it may extend completely over the front and rear end sections 22 and 50 of the assembly 20. The first receptacle 100 and second receptacle 110 define rectangular volumes when the intermediate section 42 is joined to the front end section 22 and rear end section 50. The top portion 44 matches the contours of the top, roof portions 29 and 58 so that the overall housing of the assembly 20 preferably appears as a unitary, integral structure which may be easily identified as a vehicle. Since the first receptacle 100 and second receptacle 110 are proximately disposed adjacent one another there are common definition features, namely, the rear panel 31 of the front end section 22 and the front panel 53 of the rear end section 50.

Figure 7:
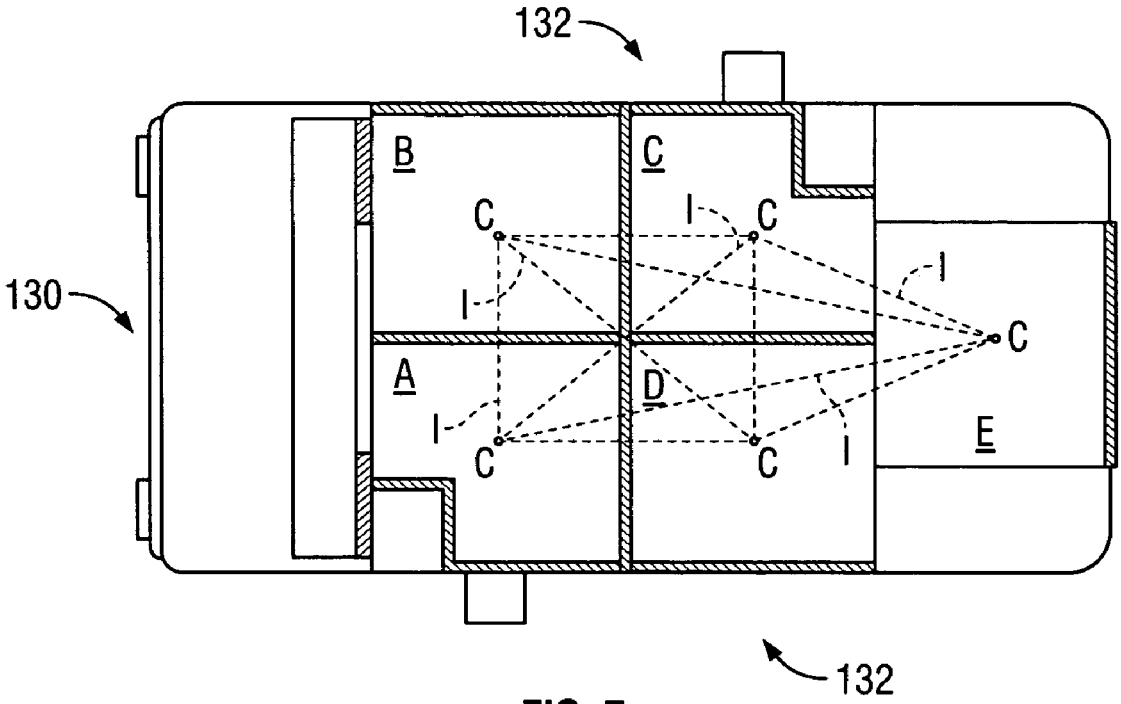
FIG. 7 is a cross-sectional schematic view of one embodiment of the entertainment assembly.

The first, second and third receptacles, 100, 110, and 120, respectively, are defined within the assembly 20 for receiving various combination of a plurality of arcade games 140 and vending machines 200, a plurality of vending machines 200 or any other desirable combination. It will be recognized that a vending machine as described herein may be any machine which facilitates dispensing of consumer products. For example, a vending machine may be any device for dispensing food, snacks, beverages or any other products fit for human consumption. This relationship is best illustrated in FIGS. 5 and 7 wherein the three receptacles 100, 110 and 120 are illustrated which accommodate a plurality of arcade games and vending machines 200, schematically represented by the letters A, B, C, D and E. It will be understood that the number of arcade games and vending machines accommodated is not limited as illustrated rather the present invention is only constrained by the physical size of the housing. Thus, the entertainment assembly 20 becomes a truly variable revenue generation device which may be easily modified to adapt to the patrons interest. For example, if at a particular location in the refreshments are being restocked on a more frequent cycle than industry norm, additional vending machines may be added or arcade games removed. It will be understood that other situations may also be easily accommodated.

Figure 3:
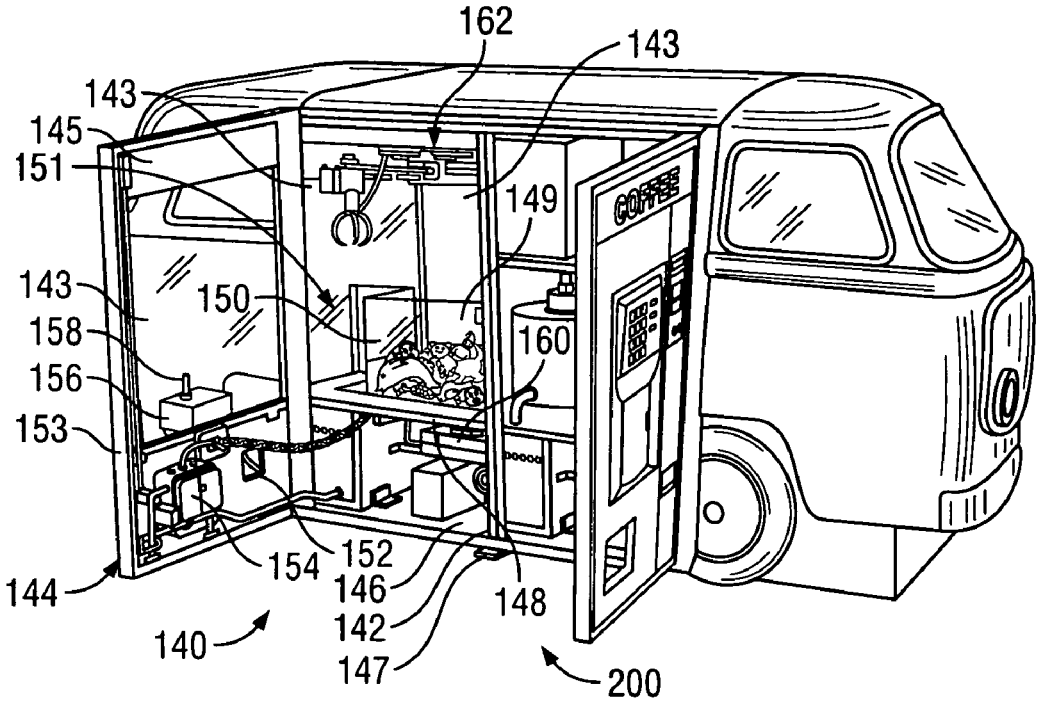
FIG. 3 is an enlarged side view of the entertainment assembly of FIG. 1 with the arcade game and vending machine doors opened.

In one embodiment of the instant invention, as shown in FIG. 3, each arcade game 140 occupies a generally rectangular volume and is comprised of three side panels 142, door panel 144, base 146, prize floor 148, retention wall 150, game electronics 160 and game mechanical devices 162. Each side panel 142 has an intermediate transparent portion 143, while the remainder of the panel 142 remains opaque. The door panel 144 is pivotally mounted to an adjacent side panel 142 so that the game unit 140 may be easily serviced, replenished or repaired. An intermediate transparent portion 143 is also illustrated between an upper marquee portion 145 and a lower opaque portion 153. Mounted to the exterior of the door panel opaque portion 153 is a player console 156, preferably having a joystick 158, and dollar bill and coin receiving slots 154 for players to insert money which activates the game. A prize retrieval aperture 152 is also formed in the door panel 144. The prize floor 148, retention wall 150 and transparent side panels 143 define a volume in which the prizes 149 are located. A prize box 151 is further defined between the retention wall 150, door panel 144 and adjacent side panel 142. If the player is successful in the operation of the game, any prize 149 will ultimately be deposited therein. In the present embodiment, the games illustrated are commonly known as a skill crane, which have been in use for many years. A plurality of various prizes are contained within a cabinet having a claw mechanism which is activated by a player outside of the game cabinet. An attempt is made to grasp and retrieve one of the prizes from the cabinets within a predetermined period of time. It will be recognized that other arcade games may be substituted therefore and the description of arcade games shall not be so limited.

Each vending machine 200 similarly occupies a generally rectangular volume and is comprised of three side panels and a door panel 202. A transparent portion 204 of the door panel 202 enable the participant or spectator to observe the snacks and drinks 206 disposed therein. In one embodiment, the three-side panels may also each include a transparent portion to facilitate an uninhibited line-of-sight for the aforementioned advantages as shown in FIGS. 2, 4 and 6. The third receptacle is configured to receive only one arcade game or vending machine. It will be recognized that certain vending machines do not easily lend themselves to use of transparent panels. However, such vending machines may be strategically located to avoid any potential downside.

In order to overcome some of the disadvantages of the prior art, a reflective or mirrored portion 74 may be defined on at least one panel 31, 53, or 55 which defines one of the receptacles 100, 110, or 120. Preferably, each panel 31, 53 and 55 has such a reflective portion 74 correspondingly dimensioned to be generally equivalent to the transparent portion 143 of the game unit side panels 142. These reflective surfaces may be used to give the impression that a smaller space is actually larger than in reality. Additionally, reflective portions 74 inside the housing 20, give viewers increased visibility of the prizes and game action, thereby generating more interest and participation in the game units 140.

The present invention additionally overcomes the disadvantages of the prior art since a longitudinal line-of-sight 130 generally along the longitudinal axis L may be created by the use and placement of transparent panels or portions. Again, increased visibility permits the arcade games and vending machines to appeal to more than just the players standing directly in front of the consoles 156. An advantage or unique feature of the present invention allows viewers to position themselves around most of the assembly yet still always have a good view of at least one game. Furthermore, a lateral line-of-sight 132 is available generally normal to the longitudinal axis L. The adjacent, contiguous configuration of the arcade games, vending machines and plurality of transparent panels not only allows viewers to watch all of the games taking place, but also all the players can watch one another during game play. Consequently, competition may be affected between neighboring or opposing players, across or diagonally situated to results, which may result in increased revenue.

As further illustrated in FIG. 7, each receptacle 100, 110 and 120 and each arcade game or vending machine identified by letters A, B, C, D and E has a geometrically defined center point C. It will be understood that every additional arcade game, vending machine or receptacle which may be added will also have a center point. The unique configuration of the present assembly is defines a polygonal relationship when an imaginary line I interconnects each receptacle 100, 110 and 120 or connects an arcade game 140 or vending machine 200 from each receptacle 100, 110 and 120. The variety of triangular shapes which may be formed include, isosceles, obtuse, or scalene.

Figure 8:
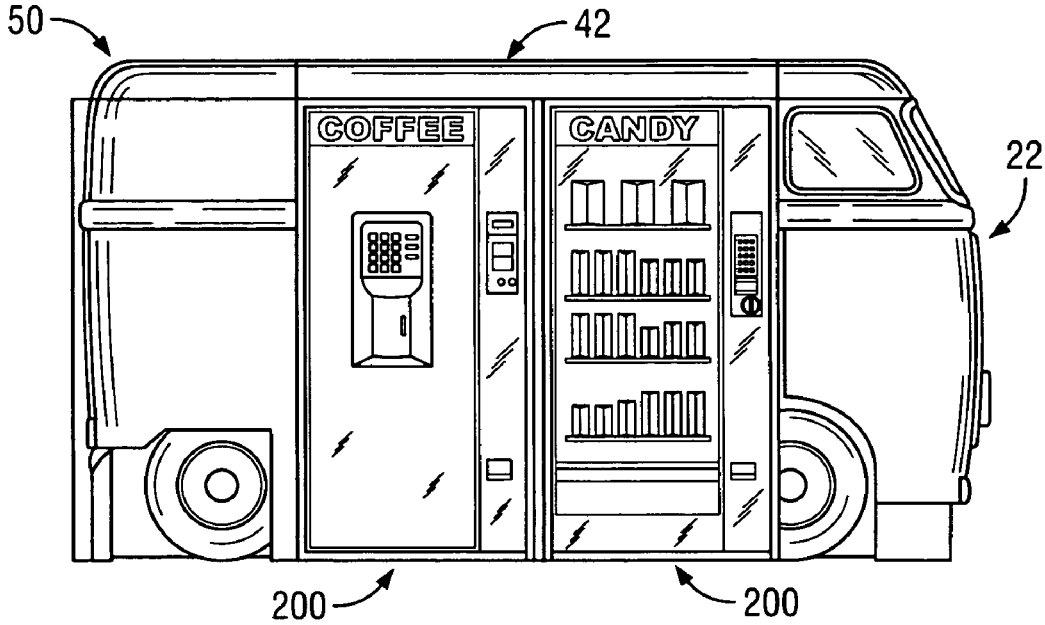
FIG. 8 is a side elevation view of another embodiment of the entertainment assembly of FIG. 1.
Figure 9:
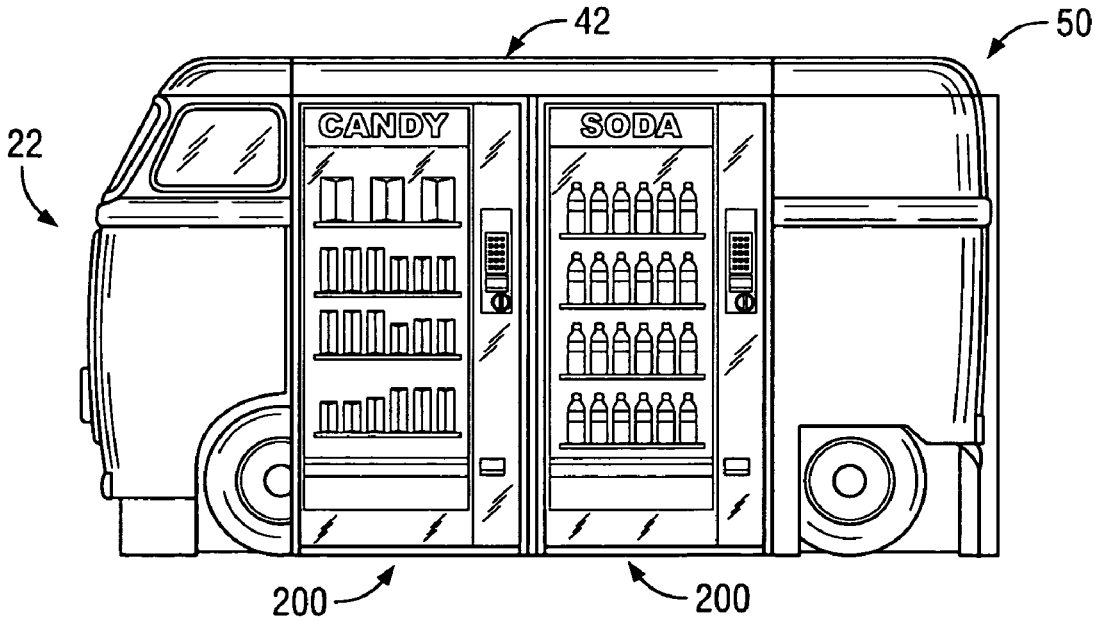
FIG. 9 is another side elevation view of the other embodiment of the entertainment assembly of FIG. 8.

FIGS. 8 and 9, when viewed collectively with FIG. 2, illustrate one embodiment of the present invention comprising a plurality of vending machines disposed in the housing. It will be understood that this embodiment overcomes the disadvantages of the prior art by providing a unique branding opportunity. A refreshment product company may decorate the vehicle with its brands, logos and other indicia to facilitate sale of its products or a "blitz-type" advertising campaign to introduce a new product or raise brand awareness. The assembly provides an attractive and enticing display through which the products may be procured. Additionally, with a plurality vending machines about the housing, patrons walk around the assembly looking for that certain item of interest. As a result, to the patron is around the assembly for a longer period of time. This increases the interest of others observing such action and draws them to the assembly location to investigate the attraction. Furthermore, new refreshment products not found elsewhere may be introduced with the present invention in order to create a memorable impression in the minds of patrons.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. An entertainment and refreshment assembly comprising:

a plurality of arcade games;

a plurality of vending machines, each including a plurality of consumer products fit for human consumption disposed therein for dispensing;

a housing including a first end section, a second end section, and an intermediate section disposed between and interconnecting the first and said second end sections such that the first and second end sections and the intermediate section cooperatively define at least two different receptacles for each receiving at least one of the arcade games and vending machines; and a third receptacle disposed in one of the first and second end sections for receiving one of the arcade games or vending machines, wherein at least one vending machine includes a door panel with a transparent portion for displaying the plurality of consumer products fit for human consumption.

2. The assembly of claim 1, wherein said first end section has distinguishing features identifiable as the front portion of a vehicle.

3. The assembly of claim 2, wherein said distinguishing features may be selected from the group consisting of headlights, windshield, windshield trim, bumper, door windows, door window trim, wheels or tires.

4. The assembly of claim 1, wherein, said second end portion has distinguishing features identifiable as the rear portion of a vehicle.

5. The assembly of claim 4, wherein said distinguishing features may be selected from the group consisting essentially of taillights, body line, bumper, wheels and tires.

6. The assembly of claim 1, wherein said at least two different receptacles are further defined by a rear panel of said front end section and a front panel of said rear end section.

7. The housing of claim 1, wherein said third receptacle is disposed in said second end section.

8. An entertainment assembly comprising:

a plurality of arcade games;

at least one vending machine, each vending machine including a plurality of consumer products fit for human consumption disposed therein for dispensing;

a housing having an exterior configuration resembling a vehicle, and an interior portion including a plurality of separate receptacles, each of said receptacles receiving a portion of at least one arcade game and vending machine; each arcade game and vending machine having a plurality of side panels, each of the side panels having a transparent portion;

a third receptacle disposed in one of the first and second end sections for receiving one arcade game or vending machine, the housing having at least one transparent panel disposed on the exterior;

the interior defined by a plurality of panels with at least one of the panels having an aperture; whereby a longitudinal and a lateral line-of-sight pass as completely unimpaired through the assembly; and visibility of prizes contained within the arcade game and products in the vending machine is increased for viewers and players of said game units, wherein at least one vending machine includes a door panel with a transparent portion for displaying the plurality of consumer products fit for human consumption.

9. The assembly of claim 8, wherein the housing has a modular construction that includes a first end action, a second end action, and an intermediate section disposed therebetween and connecting the first and second end sections.

10. The assembly of claim 9, wherein the first end section has a front portion disposed on the exterior and a rear well disposed in the interior which has said aperture formed therein.

11. The assembly of claim 8, wherein the arcade game includes a pivotally mounted front door which has a control console mounted on an exterior surface, including a joy stick, a prize retrieval portal and payment receiving apertures, and game electronics mounted on an interior thereof.

12. The assembly of claim 8, wherein the arcade game has a transparent divider wall disposed therein which defines a prize box and retains prizes in said game unit when a pivotally mounted access door is opened.

13. An entertainment and refreshment assembly comprising:

a plurality of vending machines, each including a plurality of consumer products fit for human consumption disposed therein for dispensing;

a housing including a first end section, a second end section, and an intermediate section disposed between and interconnecting the first and said second end sections such that the first and second end sections and the intermediate section cooperatively define at least two different receptacles for each receiving the vending machines; and a third receptacle disposed in one of the first and second end sections for receiving at least one of the vending machines, wherein at least one vending machine includes a door panel with a transparent portion for displaying the plurality of consumer products fit for human consumption.

14. The assembly of claim 13, wherein said first end section has distinguishing features identifiable as the front portion of a vehicle.

15. The assembly of claim 14, wherein said distinguishing features may be selected from the group consisting of headlights, windshield, windshield trim, bumper, door windows, door window trim, wheels or tires.

16. The assembly of claim 13, wherein, said second end portion has distinguishing features identifiable as the rear portion of a vehicle.

17. The assembly of claim 16, wherein said distinguishing features may be selected from the group consisting essentially of taillights, body line, bumper, wheels and tires.

18. The assembly of claim 13, wherein said at least two different receptacles are further defined by a rear panel of said front end section and a front panel of said rear end section.

19. The housing of claim 13, wherein said third receptacle is disposed in said second end section.

* * * * *